US006279213B1

(12) United States Patent
Kohlen et al.

(10) Patent No.: US 6,279,213 B1
(45) Date of Patent: Aug. 28, 2001

(54) DEVICE FOR HOLDING AND CENTERING TEXTILE YARN TUBES

(75) Inventors: Helmut Kohlen, Erkelenz; Bernhard Schmitz, Willich; Manfred Mund, Herzogenrath; Jos Rijpstra, Mönchengladbach, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/672,479

(22) Filed: Sep. 28, 2000

(30) Foreign Application Priority Data

Oct. 1, 1999 (DE) ..... 199 47 402

(51) Int. Cl.[7] ..... B65H 73/00

(52) U.S. Cl. ..... 28/292; 28/295; 28/297; 57/300

(58) Field of Search ..... 28/292, 295, 297, 28/293, 294, 296, 298; 139/244; 57/300, 303, 304, 305, 306

(56) References Cited

U.S. PATENT DOCUMENTS

| | | | | |
|---|---|---|---|---|
| 1,144,006 | * | 6/1915 | Smart et al. | 28/298 |
| 1,447,272 | * | 3/1923 | Stone | 28/298 |
| 1,666,735 | * | 4/1928 | Colman | 28/298 |
| 3,833,974 | * | 9/1974 | Girard | 28/297 |
| 4,827,582 | * | 5/1989 | Yamashita | 28/293 |
| 4,965,917 | * | 10/1990 | Ferguson | 28/295 |
| 5,109,662 | * | 5/1992 | Inger | 57/305 |
| 5,341,549 | | 8/1994 | Wirtz et al. | 28/298 |
| 5,884,468 | | 3/1999 | Reuters | 57/300 |
| 6,195,857 | * | 3/2001 | Chang et al. | 28/292 |

FOREIGN PATENT DOCUMENTS

| | | |
|---|---|---|
| 4131667A1 | 9/1991 | (DE) . |
| 19650735A1 | 12/1996 | (DE) . |

* cited by examiner

*Primary Examiner*—Amy B. Vanatta
(74) *Attorney, Agent, or Firm*—Kennedy Covington Lobdell & Hickman, LLP

(57) ABSTRACT

A device (6) for holding and centering yam tubes (3) for processing while in a vertical orientation on transport disks (2), e.g., for removing a yam remnant (4) at a tube cleaning station. During such processing, the tubes are fixed in place by means of a height-displaceable centering arbor (12) coupled with a circuit arrangement which causes the operating height (h) of the centering arbor (12) to be automatically matched to the length of the respectively provided tube (3). An arresting arrangement (20) assure that the centering arbor (12) is securely fixed in place at each of its operating heights (h).

8 Claims, 3 Drawing Sheets

DEVICE FOR HOLDING AND CENTERING TEXTILE YARN TUBES

CROSS-REFERENCES TO RELATED APPLICATIONS

This application claims the benefit of German patent application 19947402.8 filed Oct. 1, 1999, herein incorporated by reference.

FIELD OF THE INVENTION

The present invention relates to a device for holding and centering textile yarn tubes supported in a vertical orientation on transport disks for removal therefrom of winding remnants at a tube cleaning station, and relates more particularly to such a device having a centering arbor whose height can be changed by means of a drive mechanism, and an arresting means which fixes the centering arbor at its operating height.

BACKGROUND OF THE INVENTION

A device of the above described type is described, for example, in German Patent Publication DE 41 31 667 A1 in connection with a tube cleaning mechanism of a bobbin winding machine for producing cheese-type yarn packages.

Malfunctions can occur at the work stations of such cheese-producing textile machines, for example automatic cheese winders, during the process of rewinding spinning cops into large-volume cheeses, which malfunctions prevent the correct complete unwinding of the spinning cop tubes placed thereat. Such tubes with yarn remnants which are sufficiently small as to be unworthy of further unwinding must be completely cleaned, i.e. their yarn remnant completely removed, before they can be returned into the spinning/winding process.

In the course of this cleaning process, a tool is placed against the tube and is displaced parallel with respect to the tube axis to remove the remnant yarn, whereby it is necessary to center the tube exactly to avoid the danger that the tube, which stands on a disk-shaped transport body, a so-called transport disk or caddy, could be damaged.

With the device known from German Patent Publication DE 41 31 667 A1, the yarn remnants are loosened by means of a stripper which can be displaced along the tube, and the loosened remnants are subsequently suctioned off. As already indicated above, the tube body of the spinning cops having a yarn remnant stand upright on the arbors of disk-shaped transport bodies, which are conveyed by means of transport belts into the area of the tube cleaning mechanism of the bobbin winding machine, and are subsequently transported away therefrom to other operational areas of the machine over appropriate transport tracks.

During the process of removing the yarn remnants, the tube of the cop is centered, so that the cleaning tool can optimally operate by being exactly placed against the tube, and so that the tube is not lifted off the support body in the course of stripping off the yarn remnant.

For this purpose, the device in accordance with German Patent Publication DE 41 31 667 A1 has a centering arbor, whose operating height is exactly matched to the length of the cop tubes of the respective batch of yarn. When a new batch of yarn is to be wound, and the height of the tubes utilized for the new batch is changed, the centering device must be manually reset.

Thus, processing of tubes of different lengths is not possible with the known tube cleaning mechanism. In case the bobbin winding machine is occupied by several batches, wherein two or more groups of cops having tubes of different length rotate simultaneously through the transport system of the textile machine, it is necessary to employ two or more tube cleaning mechanisms, which are set to different heights.

A device for holding down and centering tubes is also known, for example, from German Patent Publication DE 196 50 735 A1, which has a rotatably seated holder with a plurality of centering arbors, which differ in diameter, as well as in length. Here, the different centering arbors can be used alternatingly.

However, it is disadvantageous in connection with this known device that the centering process can only take place automatically if the length and the diameter of the respective tubes to be cleaned have been previously determined in a relatively elaborate manner by sensor means, which as a rule are comparatively expensive. This known device has not found acceptance in actual operations within the industry.

OBJECT AND SUMMARY OF THE INVENTION

In view of the above mentioned prior art, it is therefore an object of the present invention to provide a device of the afore-described type for holding down and centering textile yarn tubes while supported on transport disks for removal therefrom of winding remnants at a tube cleaning station which device assures the secure fixation in place of the tubes, in particular during tube cleaning, at any time and independent to the greatest extent of the format, i.e., the type and size, of the tube.

Basically, this object of the present invention is attained by providing an improved device for holding and centering a yarn tube while supported in an upright orientation on a transport disk disposed at a processing station, such as a tube cleaning station for removing unused yarn remnants from yarn tubes. Briefly, summarized, the device of the present invention comprises a centering arbor for engagement with the yarn tube, a drive mechanism for moving the centering arbor upwardly and downwardly relative to the processing station for moving the centering arbor into engagement with the yarn tube, and an arresting means for fixing the centering arbor at an operating height. In accordance with the present invention, the arresting means comprises a circuit arrangement coupled with the centering arbor and with the drive mechanism and operable for automatically deactuating movement of the drive mechanism at an operating height of the centering arbor matched to the length of the yarn tube, and means for locking the centering arbor at the operating height.

The present invention has the particular advantage that the centering arbor of the hold-down and centering device is always set automatically to the height of the tubes provided. Thus, when using the device in accordance with the invention, the manual setting and adjustment work, which as a rule had been required heretofore in case of batch changes, is avoided. The device of the present invention furthermore offers the option of operating an automatic cheese winder when working several yarn batches, wherein tubes of different lengths of the different yarn batches can be processed in a common tube cleaning mechanism and can be securely fixed in place in the process.

In such case, the circuit arrangement, which automatically matches the operating height of the centering arbor to the respective tube present thereat, is coupled with the centering arbor and preferably is at least partially integrated into the centering arbor. Such a circuit arrangement integrated into the centering arbor is insensitive to the difficult atmospheric conditions often found in spinning factories, and is almost maintenance-free.

In an advantageous manner, the drive mechanism comprises a bridge member connected to the centering arbor and the centering arbor comprises an at least partially hollow centering arbor sleeve, a centering arbor core fixed on the bridge member, and an actuating pin displaceably seated in the centering arbor core. Preferably, the circuit arrangement comprises a Hall sensor connected to a control device for actuating and deactuating the drive mechanism and a permanent magnet fixed on the actuating pin for dampening the Hall sensor at the operating height of the centering arbor. The circuit arrangement of such an embodiment has been proven to be extremely insensitive to atmospheric conditions and very dependable. Furthermore, the circuit arrangement is relatively low cost, particularly because of using a Hall sensor.

In a preferred embodiment, the centering arbor sleeve is seated displaceably in relation to the centering arbor core, and a spring element is interposed therebetween. The centering arbor sleeve is connected with the centering arbor core via a tensioning pin which extends through an elongated bore hole in the centering arbor core. This embodiment advantageously prevents the centering arbor from being placed on the tube tip at too high a contact pressure, which could lead to damage of the tube. Moreover, possible variations in the lengths of the tubes caused by production tolerances are compensated without problems by the spring element.

It is further preferred that the fixation of the tubes at each operating height of the centering arbor is performed by a locking device embodied as a ratchet mechanism operating between the centering arbor and the drive mechanism. Such a ratchet mechanism constitutes a proven device, by which an interlocking arresting of the centering arbor is assured.

In particular, the ratchet mechanism preferably comprises a first toothed element affixed for unitary movement upwardly and downwardly with the centering arbor, a second toothed element supported in a vertically fixed disposition for limited pivotability relative to the centering arbor, and a spring for urging the second toothed element pivotably into engagement with the first toothed element. Such an embodiment assures that the centering arbor is always moved dependably into its operating position defined by the respective length of the tube present, and is securely fixed in place thereat when an axial force is applied to the centering arbor by the cleaning tool of the tube cleaning mechanism. Thus, the use of the ratchet mechanism assures an automatic, relatively sensitive fixation in place of the centering arbor.

In an advantageous embodiment, the components of the ratchet mechanism are made of a wear-resistant material, preferably hardened steel. Such a ratchet mechanism is not only of relatively low cost and very dependable, it is also distinguished by a long service life.

Further features and advantages of the present invention will be explained and understood in greater detail from the following disclosure of an exemplary embodiment represented in the accompanying drawings.

DETAILED DESCRIPTION OF THE PREFERRED EMBODIMENT

Figures 1, 4:
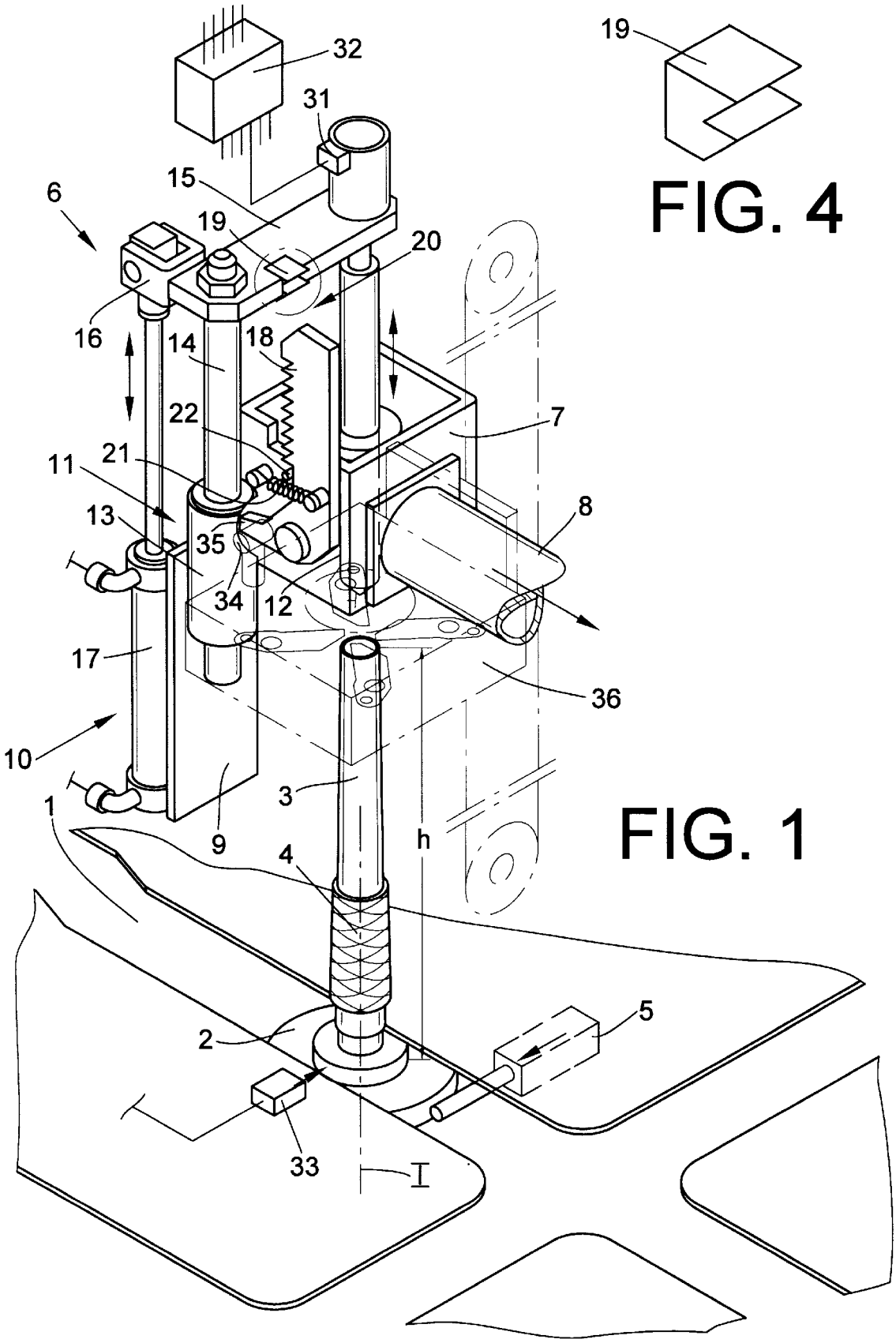
FIG. 1 is a top perspective view of a preferred embodiment of device in accordance with the present invention for holding down and centering tubes, shown in a resting inoperative position.
FIG. 4 is a detailed perspective view of the support element of the ratchet gear mechanism on an enlarged scale.
Figures 2, 3:
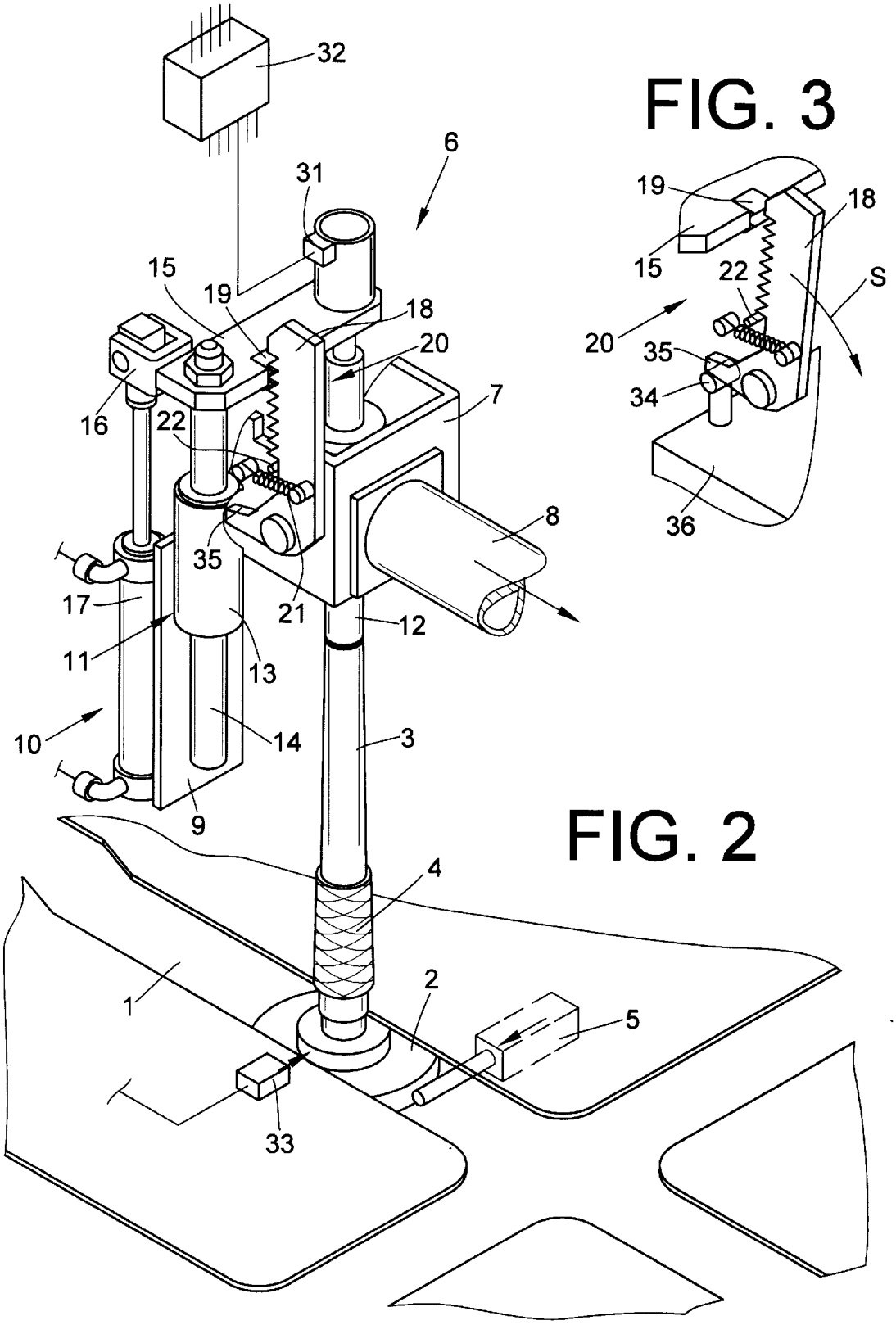
FIG. 2 is another top perspective view of the device of FIG. 1 in one of its operating positions.
FIG. 3 is a detailed perspective view of the ratchet gear mechanism of the device of FIGS. 1 and 2.

Referring now to the accompanying drawings and initially to FIGS. 1 and 2, a transport track of a cop and tube transport system for an automatic cheese winder is indicated by 1 in FIGS. 1 and 2. Yarn-wound cops and empty or partially unwound cop tubes 3 are transported in an upright orientation on transport disks 2 on this transport track 1. The tube 3 represented in FIGS. 1 and 2 has an unwound yarn remnant 4, which is to be removed by a tube cleaning mechanism (represented only at 36 in faint broken lines in FIG. 1) but extensively explained in German Patent Publication DE 41 31 667 A1.

A device 6 in accordance with the present invention for holding down and centering the tubes 3 during remnant removal is disposed above the transport track 1, and adjacent thereto a stop device 5 is also arranged in the area of the tube cleaning mechanism for causing the transport disks 2 delivered on the transport track 1 to be positioned in a preselected operating position I.

The device 6 for holding down and centering tubes 3 includes the following basic components: a drive mechanism 10, a guide mechanism 11, a bridge member 15, and a centering arbor 12.

In this embodiment, the guide mechanism 11 and the drive mechanism 10 are connected via a connecting bracket 9 to a suction housing 7, which in turn is connected via a suction air connector 8 to a dirt removal device (not represented), which is part of the bobbin winding machine. The drive mechanism 10 is preferably designed as a thrust piston 17. The guide mechanism 11 has a rod-like guide element 14, which reciprocates in a guide sleeve 13. The bridge member 15 is fastened at the end of the guide element 14 and is also connected via a rod tip 16 to the thrust piston 17. The centering arbor 12 is mounted on the end of the bridge member 15 located opposite the guide mechanism 11.

As can be seen in FIGS. 1 and 2 in particular, a ratchet gear mechanism, identified as a whole by 20, is also arranged on the suction housing 7 and includes a toothed element 18 which is pivotable over a limited distance. Here, the toothed element 18 is acted upon by a spring element 21 to urge the toothed element 18 into a resting position against a stop 22 as represented in FIG. 1.

In the operating positions of the centering arbor 12, the toothed element 18 works together with a correspondingly toothed support element 19 arranged on the bridge member 15.

Figure 5:
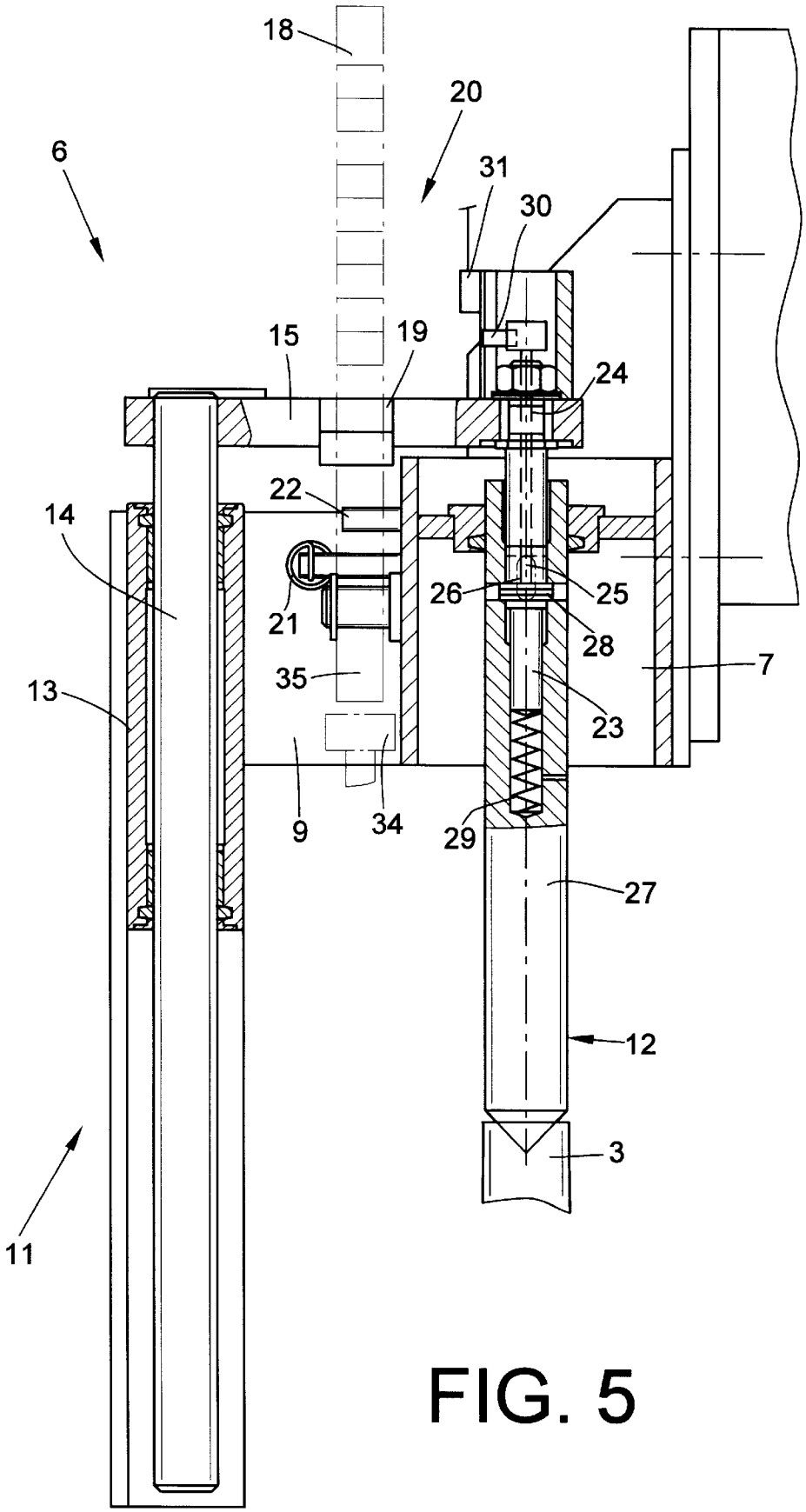
FIG. 5 is a front elevational view, partially in vertical cross-section, of the device represented in FIGS. 1 and 2.

As indicated in FIG. 5, the centering arbor 12 comprises several components, which are seated displaceably in relation to each other. A centering arbor core 23 is fastened on the bridge member 15 and has a center bore 24 in which an actuating pin 25 is slidingly guided. In addition, the centering arbor core 23 has an elongated bore hole 26, through which passes a tensioning pin 28 which is fixed in place on a centering arbor sleeve 27. Thus, the centering arbor sleeve 27 is disposed to be movable relative to the centering arbor core 23 via the tensioning pin 28 and the elongated bore hole 26. In addition, a spring element 29 is disposed between the centering arbor core 23 and the centering arbor sleeve 27.

On its end, the actuating pin 25 has a permanent magnet 30, which can be displaced into the area of a Hall sensor 31 and which then dampens it. The Hall sensor 31 is connected to a control device, for example the control device 32 (FIGS. 1 and 2) of the tube cleaning mechanism.

The operation of the device may thus be understood. Yarn cops whose tubes could not be completely unwound at the winding stations of the automatic cheese winder must first be completely cleaned of the yarn remnants thereon, before they can be returned to the ring spinning machine.

Thus, such tubes, as represented, for example, by the tube 3 with its a winding remnant 4, are temporarily removed from the normal transport circuit between the spinning machine and the bobbin winding machine and are brought via the transport track 1 to a tube cleaning mechanism, such as is known, for example, from German Patent Publication DE 41 31 667 A1.

Transport disks 2, which convey such tubes 3 with a winding remnant 4, are initially positioned at this tube cleaning mechanism by means of the afore-mentioned stop device 5, are centered in the manner presently described below by the device 6 in accordance with the present invention, and are subsequently processed by the tube cleaning mechanism in a manner known per se and therefore not explained.

In actual operations, the drive mechanism 10 for the centering arbor 12 is actuated when a sensor device 33, which is arranged in the area of the tube cleaning mechanism and is also connected to the control device 32, determines that a transport disk 2 with a tube 3 having a winding remnant 4 to be removed, has entered the operating position I and has been positioned by the stop device 5.

Thereupon, the thrust piston 17 is actuated to move in an "enter" direction to lower the bridge member 15 and the centering arbor 12 fastened thereon as a unit under the guidance of the guide mechanism 11 in the direction toward the upper tip of the cop tube 3 causing the centering arbor 12 to be placed from above on the tube 3 positioned in the operating position I, regardless of the length of the respective tube 3. FIG. 2 shows the device 6 of the present invention in this operating position.

Following the initial contact of the centering arbor 12 with the tip of the cop tube 3, the bridge member 15 continues to be lowered further, causing a relative movement to occur between the centering arbor core 23 and the centering arbor sleeve 27 seated on the tube tip, and in turn the actuating pin 25 is displaced to slide in the central bore 24 of the centering arbor core 23. In the course of this displacement, the actuating pin 25 and the permanent magnet 30 arranged on the actuating pin 25 enters the area of the Hall sensor 31 and dampens it. The control signal from the Hall sensor 31 thereby generated is transmitted to the control device 32, which immediately stops the driving force of the thrust piston 17 from further lowering of the bridge member 15.

During the lowering of the bridge member 15, and therefore of the centering arbor 12, the toothed element 18 of the ratchet gear 20 and the correspondingly toothed portion of the support element 19 become interlocked. That is, in the course of the lowering of the bridge member 15, the support element 19 on the bridge member 15 engages and slides downwardly along the toothed element 18, which is urged into engagement therewith by the spring element 21 but yields to the downward movement of the support element 19 by pivoting slightly away therefrom against the force of the spring element 21.

As can be seen from FIGS. 3 and 4, the arresting teeth formed on the support element 19 and on the toothed element 18, are configured such that the engagement of the components 18, 19 act in a ratchet-like manner to permit the lowering of the bridge member 15 in the direction toward the tube 3, but interlockingly block the lifting of the bridge member 15 by an axial force acting on the centering arbor 12.

Thus, the device of the present invention for holding down and centering tubes 3 is not only automatically adapted to each tube length, but rather an interlocking blockage of the bridge member 15, and therefore of the centering arbor 12, at every operating height h automatically takes place via the ratchet gear 20.

Following the termination of the tube cleaning process which, as already indicated several times above, is known and extensively described, for example, in German Patent Publication DE 41 31 667 A1, the ratchet gear 20 is released by means of a stop 34 arranged on the cleaning carriage 36 of the tube cleaning mechanism, as indicated in FIG. 3. That is, when the cleaning carriage 36 (also represented in faint broken lines in FIG. 1) is lifted, the stop 34 on the cleaning carriage 36 of the tube cleaning mechanism is, as schematically indicated in FIGS. 1 and 3, moved from below against the angled switching arm 35 of the toothed element 18, which as a result is pivoted in the direction S against the force of the spring element 21. In this pivoted open position of the toothed element 18, the bridge member 15 is again unblocked, so that the centering arbor 12 can be moved back into its initial position by the thrust piston 17.

Since textile machines producing cheeses can also have other processing stations, besides the above described tube cleaning mechanisms, where centering of the tube during processing may be necessary or desirable, the employment of the device of the present invention for holding down and centering a tube is not limited to tube cleaning mechanisms. Instead, the device in accordance with the invention also makes sense and can be advantageously employed at other processing stations of a textile machine, for example at a cop preparation station, whereat a reserve yarn winding is loosened from ring spinning cops and/or the yarn end is placed in a ready position for a subsequent rewinding process.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A device for holding and centering a yarn tube while supported in an upright orientation on a transport disk disposed at a processing station, the device comprising a centering arbor for engagement with the yarn tube, a drive mechanism for moving the centering arbor upwardly and downwardly relative to the processing station for moving the centering arbor into engagement with the yarn tube, and an arresting means for fixing the centering arbor at an operating height, the arresting means comprising a circuit arrangement coupled with the centering arbor and with the drive mechanism and operable for automatically deactuating movement of the drive mechanism at an operating height of the centering arbor matched to the length of the yarn tube, and means for locking the centering arbor at the operating height.

2. The device in according with claim 1, wherein the drive mechanism comprises a bridge member connected to the centering arbor and the centering arbor comprises an at least partially hollow centering arbor sleeve, a centering arbor core fixed on the bridge member, and an actuating pin displaceably seated in the centering arbor core.

3. The device in according with claim 2, wherein the circuit arrangement comprises a Hall sensor connected to a control device for actuating and deactuating the drive mechanism and a permanent magnet fixed on the actuating pin for dampening the Hall sensor at the operating height of the centering arbor.

4. The device in according with claim 2, wherein the centering arbor sleeve is seated displaceably in relation to the centering arbor core, and a spring element is interposed therebetween.

5. The device in according with claim 2, wherein the centering arbor sleeve is connected with the centering arbor core via a tensioning pin which extends through an elongated bore hole in the centering arbor core.

6. The device in according with claim 1, wherein the locking means comprises a ratchet mechanism operating between the centering arbor and the drive mechanism.

7. The device in according with claim 6, wherein the ratchet mechanism comprises a first toothed element affixed for unitary movement upwardly and downwardly with the centering arbor, a second toothed element supported in a vertically fixed disposition for limited pivotability relative to the centering arbor, and a spring for urging the second toothed element pivotably into engagement with the first toothed element.

8. The device in according with claim 7, wherein each of the toothed elements are made of a wear-resistant material.

* * * * *